US009392896B1

(12) United States Patent
Lieck, Jr. et al.

(10) Patent No.: US 9,392,896 B1
(45) Date of Patent: Jul. 19, 2016

(54) CLOTHES HANGER FOR RETAINING THE GARMENTS SHAPE

(71) Applicants: Walter Lieck, Jr., Rio Grande City, TX (US); Julia Lieck, Rio Grande City, TX (US)

(72) Inventors: Walter Lieck, Jr., Rio Grande City, TX (US); Julia Lieck, Rio Grande City, TX (US)

( * ) Notice: Subject to any disclaimer, the term of this patent is extended or adjusted under 35 U.S.C. 154(b) by 0 days.

(21) Appl. No.: 14/617,547

(22) Filed: Feb. 9, 2015

(51) Int. Cl.
*A47G 25/28* (2006.01)
*A47G 25/20* (2006.01)
*A47G 25/40* (2006.01)
*A47G 25/44* (2006.01)

(52) U.S. Cl.
CPC ..... *A47G 25/28* (2013.01); *A47G 25/20* (2013.01); *A47G 25/40* (2013.01); *A47G 25/44* (2013.01); *A47G 25/441* (2013.01)

(58) Field of Classification Search
CPC ..... A47G 25/14; A47G 25/16; A47G 25/18; A47G 25/20; A47G 25/44; A47G 25/441; A47G 25/445; A47G 25/62; A47G 25/623; A47G 25/66; A47G 25/28; A47G 25/40; A47F 7/19; A41D 27/22
USPC ..... D6/319, 324
See application file for complete search history.

(56) References Cited

U.S. PATENT DOCUMENTS 1,052,426 A * 2/1913 Ringler ..... D06F 59/02 223/69
2,060,395 A * 11/1936 Urth ..... D06F 59/02 223/69
2,513,980 A * 7/1950 Widmann ..... A47G 25/443 223/89
2,539,895 A * 1/1951 Cuneo ..... A47G 25/20 223/69
2,556,530 A * 6/1951 Fichman ..... A47G 25/447 223/90
2,582,669 A * 1/1952 Battle ..... A47G 25/447 223/86
2,835,422 A * 5/1958 Stuard ..... A47G 25/30 223/92
2,929,538 A 3/1960 Douglass
3,029,990 A * 4/1962 Roberts ..... A47G 25/16 223/88
3,208,651 A * 9/1965 Sklarow ..... A47G 25/20 223/68
3,695,492 A 10/1972 Sheba
5,598,957 A * 2/1997 Bell ..... A47G 25/443 223/85
8,028,869 B2 10/2011 Rossaki

FOREIGN PATENT DOCUMENTS

GB 255685 A * 7/1926

* cited by examiner

*Primary Examiner* — Ismael Izaguirre
(74) *Attorney, Agent, or Firm* — Crossley & Stevenson Intellectual Property Law

(57) ABSTRACT

A clothes hanger for retaining the garments shape including a lower frame and upper section with a first support arm and a second support arm centrally conjoined. A bottom side of the frame has a right section and a left section separated from the right section at a threaded proximal end of each of the right and left sections. A turnbuckle engages the proximal end of each of the right and left sections. The turnbuckle secures the proximal ends together and adjusts the width of the bottom side. A first hook is disposed on the center point with an inverted U-shaped upper end. A U-shaped second hook is disposed on each of an interior side of each outer end of each of the respective first and second support arm. A groove is centrally disposed on a top portion of each of the first and second support arm.

2 Claims, 2 Drawing Sheets

CLOTHES HANGER FOR RETAINING THE GARMENTS SHAPE

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of garment hangers are known in the prior art. However, what is needed is a clothes hanger for retaining the garments shape with an adjustable lower frame. Garment hangers are well known for hanging garments. The present device not only hangs clothing, but keeps them wrinkle free and enhances organization. The present device prevents the need to re-iron a garment before the garment can be worn and ensures that the garment looks professional and neat. A turnbuckle allows the device to be adjusted to accommodate both smaller and larger plus size clothing without the need for multiple sized garment hangers. The present device is producible in several sizes to ensure a proper seating of the garment to the hanger to maximize shape retainment.

FIELD OF THE INVENTION

The present invention relates to garment hangers, and more particularly, to a clothes hanger for retaining the garments shape.

SUMMARY OF THE INVENTION

The general purpose of the present clothes hanger for retaining the garments shape, described subsequently in greater detail, is to provide a clothes hanger for retaining the garments shape which has many novel features that result in a clothes hanger for retaining the garments shape which is not anticipated, rendered obvious, suggested, or even implied by prior art, either alone or in combination thereof.

To accomplish this, the present clothes hanger for retaining the garments shape includes parallelepiped lower frame with a top side, a bottom side, a right side and a left side. There is an upper section with a first support arm and a second support arm identical to the first. The first and second support arms are conjoined at a center point. The center point is disposed along an imaginary vertical mid-line axis of the lower frame and the upper section. Each of the first and second support arms has an outer end disposed on the respective right side and left side. The bottom side has a right section and a left section separated from the right section at a threaded proximal end of each of the right and left sections. A cylindrical turnbuckle securingly engages the proximal end of each of the right and left sections of the bottom side. The turnbuckle is configured to secure the proximal ends together and to adjust the width of the frame bottom side allowing the frame to be adjusted to a desired width to ensure that the garments shape is retained. The width adjustment also prevents the clothing from falling off of the clothes hanger for retaining the garments shape. A first hook is vertically disposed on the center point, the first hook having an inverted U-shaped upper end, wherein the upper end is directed away from the center point. The first hook is configured to engage and alternately disengage a bar in a closet. A u-shaped second hook disposed on each of an interior side of each outer end of each of the respective first and second support arm providing extra securement of some garments as needed. A groove is centrally disposed on a top portion of each of the first and second support arm and is provided to prevent clothing from sliding off of each support arm.

Thus has been broadly outlined the more important features of the present clothes hanger for retaining the garments shape so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
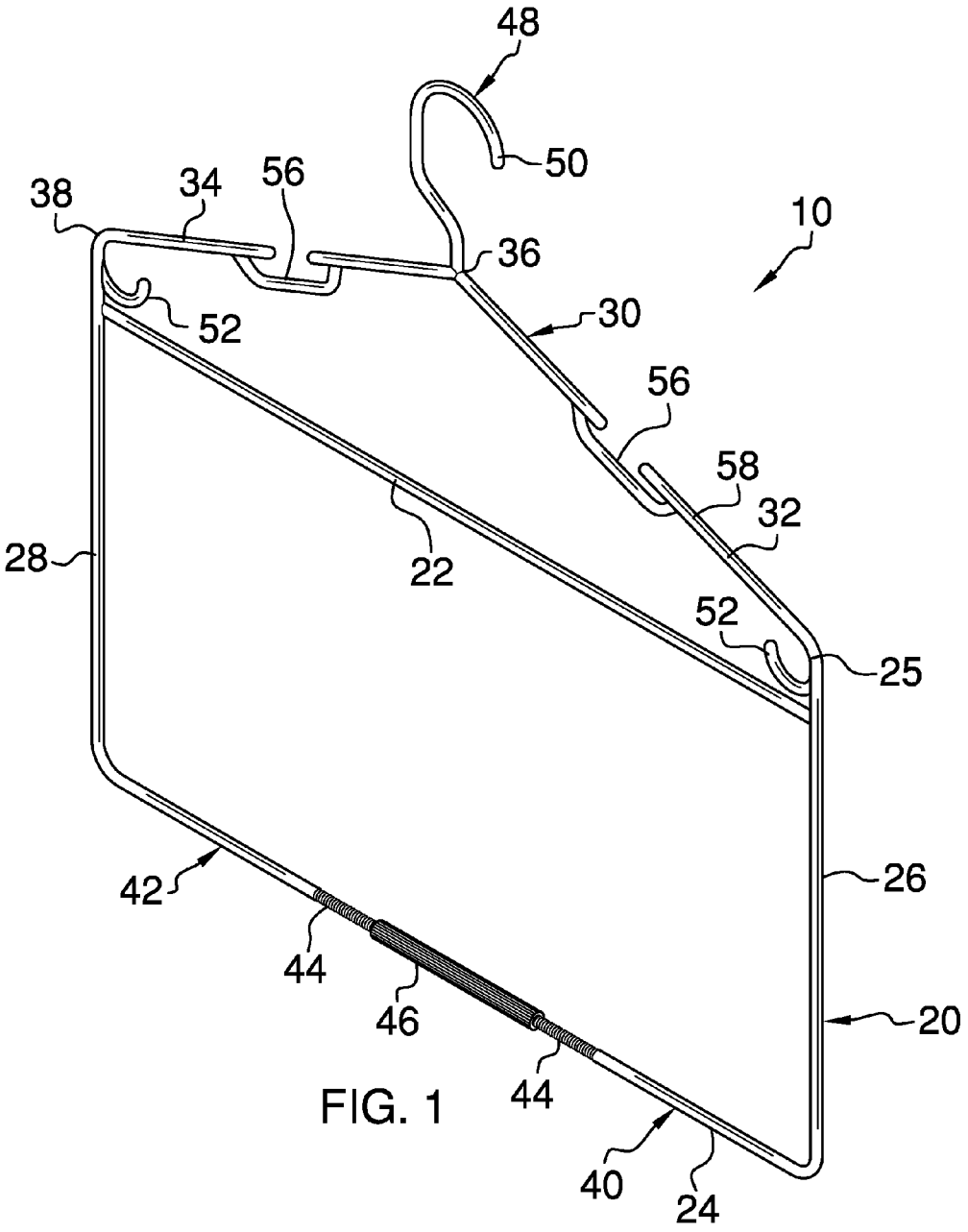
FIG. 1 is an isometric view.
Figure 2:
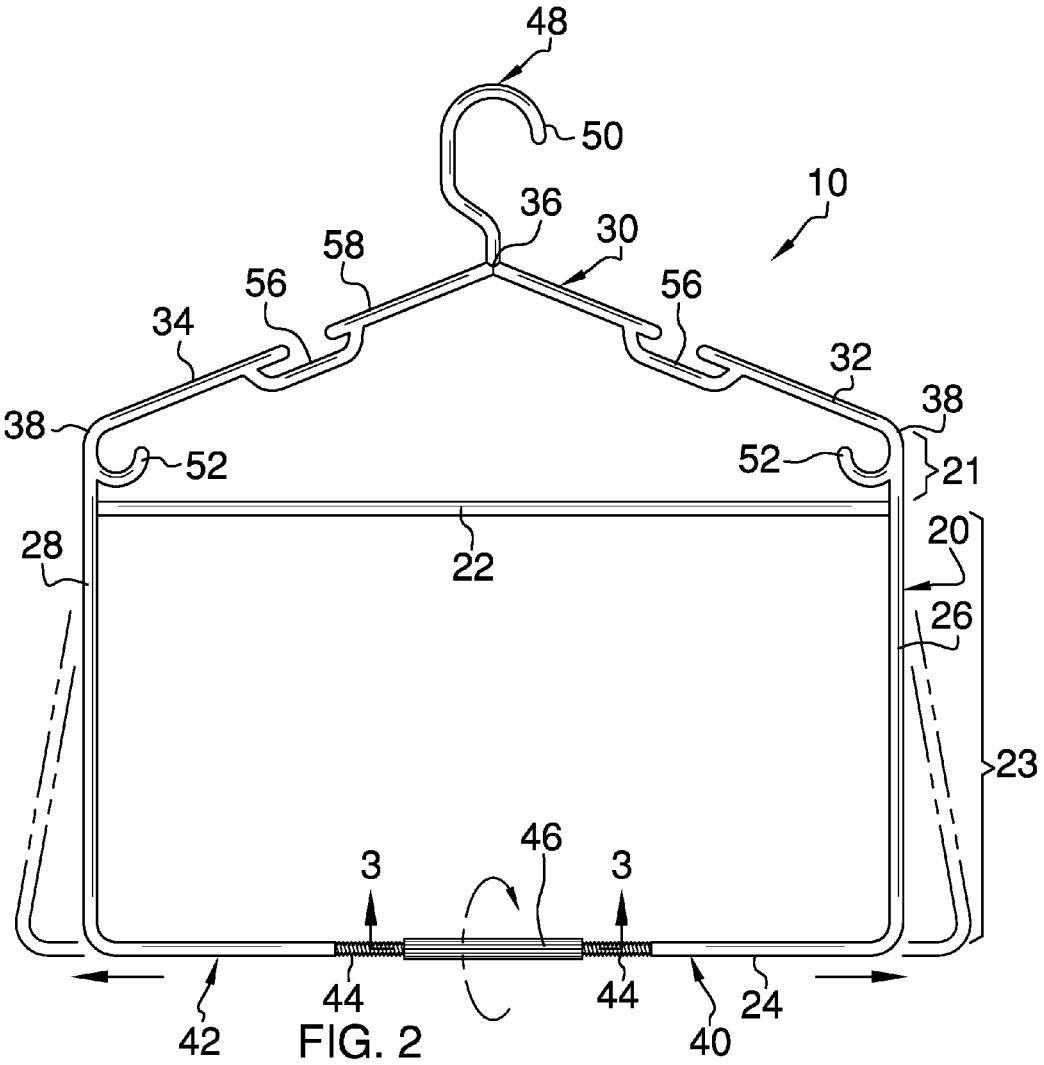
FIG. 2 is a front view showing the adjustability.
Figure 3:
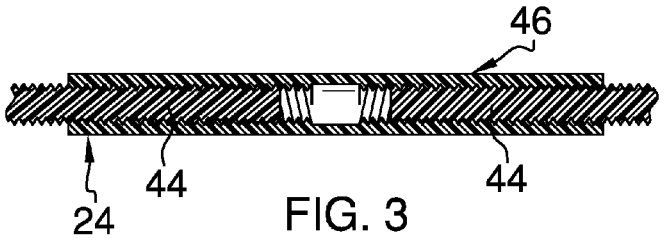
FIG. 3 is a cross-sectional view taken along line 3-3 of FIG. 2.

With reference now to the drawings, and in particular FIGS. 1 through 3 thereof, an example of the instant clothes hanger for retaining the garments shape employing the principles and concepts of the present clothes hanger for retaining the garments shape and generally designated by the reference number 10 will be described.

Referring to FIGS. 1 through 3 the present clothes hanger for retaining the garments shape 10 is illustrated. The clothes hanger for retaining the garments shape 10 includes a parallelepiped lower frame 20 with a top side 22, a bottom side 24, a right side 26 and a left side 28. Each of the right side 26 and the left side 28 has an upper portion 21 and a lower portion 23. The top side 22 is substantially perpendicularly disposed between the upper portion 21 and the lower portion 23 of each of the right side 26 and the left side 28. There is an upper section 30 with a first support arm 32 and a second support arm 34 identical to the first support arm 32. The first and second support arms 32, 34 are conjoined at a center point 36. The center point 36 is disposed along an imaginary vertical mid-line axis of the lower frame 20 and the upper section 30. Each of the first and second support arms 32, 34 has an outer end 38 continuously attached to a top end 25 of the upper portion 21 of the respective right side 26 and left side 28. The bottom side 24 has a right section 40 and a left section 42 separated from the right section 40 at a threaded proximal end 44 of each of the right and left sections 40, 42. A cylindrical turnbuckle 46 securingly engages the proximal end 44 of each of the right and left sections 40, 42 of the bottom side 24. The turnbuckle 46 is configured to secure the proximal ends 44 together and to adjust the width of the lower frame 20 bottom side 24 allowing the lower frame 20 to be adjusted to a desired width to ensure that the garments shape is retained. The width adjustment also prevents the clothing from falling off of the clothes hanger for retaining the garments shape 10. A first hook 48 is vertically disposed on the center point 36, the first hook 48 has an inverted U-shaped upper end 50, wherein the upper end 50 is directed away from the center point 36. The first hook 48 is configured to engage and alternately disengage a bar in a closet. A u-shaped second hook 52 disposed on each of the right side 26 and the left side 28 between the top end 25 of the upper portion 21 and the top side 22 providing extra securement of some garments as needed. A groove 56 is centrally disposed on a top portion 58 of each of the first and second support arm 32, 34 and is provided to prevent clothing from sliding off of each of the first and second support arm 32, 34.

What is claimed is:

1. A clothes hanger for retaining the garments shape comprising:

An adjustable lower frame having a top side, a bottom side, a right side and a left side, each of the right side and the left side having an upper portion and a lower portion, wherein the top side is substantially perpendicularly disposed between the upper portion and the lower portion of each of the right side and the left side;

an upper section having a first support arm and a second support arm identical to the first, the first and second support arms conjoined at a center point, wherein the center point is disposed along an imaginary vertical mid-line axis of the lower frame and the upper section;

wherein each of the first and second support arms further has an outer end continuously attached to a top end of the upper portion of the respective right side and left side;

wherein the bottom side has a right section and a left section separated from the right section at a threaded proximal end of each of the right and left sections;

a turnbuckle securingly engaging the proximal end of each of the right and left sections of the bottom side, the turnbuckle configured to secure the proximal ends together and to adjust the width of the frame bottom side;

a first hook vertically disposed on the center point, the first hook having an inverted U-shaped upper end, wherein the upper end is directed away from the center point.

2. A clothes hanger for retaining the garments shape comprising:

a parallelepiped lower frame having a top side, a bottom side, a right side and a left side, each of the right side and the left side having an upper portion and a lower portion, wherein the top side is substantially perpendicularly disposed between the upper portion and the lower portion of each of the right side and the left side;

an upper section having a first support arm and a second support arm identical to the first, the first and second support arms conjoined at a center point, wherein the center point is disposed along an imaginary vertical mid-line axis of the lower frame and the upper section;

wherein each of the first and second support arms further has an outer end continuously attached to a top end of the upper portion of the respective right side and left side;

wherein the bottom side has a right section and a left section separated from the right section at a threaded proximal end of each of the right and left sections;

a cylindrical turnbuckle securingly engaging the proximal end of each of the right and left sections of the bottom side, the turnbuckle configured to secure the proximal ends together and to adjust the width of the frame bottom side;

a first hook vertically disposed on the center point, the first hook having an inverted U-shaped upper end, wherein the upper end is directed away from the center point;

a second hook disposed on each of the right side and the left side between the top end of the upper portion and the top side; and a groove centrally disposed on a top portion of each of the first and second support arm;

wherein each of the second hook is u-shaped.

* * * * *